United States Patent [19]

Merkle

[11] Patent Number: 4,864,945

[45] Date of Patent: Sep. 12, 1989

[54] CURVED NOSE REFRACTORY CONSTRUCTION

[75] Inventor: Frank P. Merkle, Hanover, Ill.

[73] Assignee: Merkle Engineers, Inc., Galena, Ill.

[21] Appl. No.: 231,490

[22] Filed: Aug. 12, 1988

[51] Int. Cl.[4] ..... F23M 5/06

[52] U.S. Cl. ..... 110/334; 110/339; 110/332; 432/252

[58] Field of Search ..... 110/331, 332, 333, 334, 110/335, 336, 338, 339; 432/247, 252

[56] References Cited

U.S. PATENT DOCUMENTS

| | | | |
|---|---|---|---|
| 1,582,275 | 4/1926 | Kellner . | |
| 1,636,603 | 7/1927 | Hamilton . | |
| 1,764,707 | 6/1930 | Abbott . | |
| 2,132,517 | 10/1938 | Reintjes . | |
| 2,272,015 | 2/1942 | Lanyon . | |
| 2,457,965 | 1/1949 | Young | 110/334 |
| 2,657,651 | 11/1953 | Forsyth | 110/339 |
| 2,685,264 | 8/1954 | Reintjes . | |
| 2,738,744 | 3/1956 | Longenecker | 110/334 |
| 3,132,447 | 5/1964 | Hosbein | 110/336 X |
| 3,161,162 | 12/1964 | Homolya | 110/331 |
| 3,239,984 | 3/1966 | Hosbein | 110/332 X |
| 3,958,519 | 5/1976 | Merkle, Jr. | 110/332 |
| 4,463,689 | 8/1984 | James | 110/334 |

OTHER PUBLICATIONS

Brochure entitled "Modu-Lok", Merkle Engineers, Inc., Galena, Illinois date;-unknown.

Brochure entitled "Suspended and Tied Back Refractory Systems for Incineration and Resource Recovery Projects", Merkle Engineers, Inc., Galena, Illinois date-;-unknown.

*Primary Examiner*—Henry C. Yuen

*Attorney, Agent, or Firm*—Thomas W. Speckman

[57] ABSTRACT

A high temperature furnace curved nose construction having refractories suspended from a support structure wherein a combination of radial filler refractories and rectangular filler refractories are supported by rectangular hanger refractories. Each radial filler refractory is supported by radially adjacent rectangular filler and/or rectangular hanger refractories. Each radial filler refractory has opposed converging tread sides while each rectangular filler refractory and rectangular hanger refractory have four tread sides. The tread sides of a radial filler refractory mates with the tread sides of a rectangular filler refractory or a rectangular hanger refractory. Any combination of at least one rectangular hanger refractory, at least one rectangular filler refractory and at least one radial filler refractories mate by their tread sides to form at least a section of the curved nose construction.

10 Claims, 3 Drawing Sheets

CURVED NOSE REFRACTORY CONSTRUCTION

BACKGROUND OF THE INVENTION

1. Field of the Invention

This invention relates to a nose construction, particularly for high temperature furnaces, which provides a bend or turn in a layer of refractory bricks. High temperature furnaces may include a curved wall portion known as a fantail turn or nose construction which makes the transition between a vertical or angled wall and a suspended horizontal roof, or between two walls having some other angular relationship to each other. The nose constructions to which this invention relate have their center of radius outside the cold side of the furnace.

2. Description of the Prior Art

Existing fantail turn or nose construction designs suspend refractories from the cold side of a furnace with at least each pair of refractories requiring a suspension hanger creating a maze of suspension hangers. Existing nose constructions generally comprise a plurality of wedge-shaped refractories having generally planar opposing sides which converge toward the cold side of the nose construction, as taught by U.S. Pat. Nos. 1,636,603, 1,764,707, 2,132,517, 2,272,015 and 2,685,264. U.S. Pat. No. 1,582,275 teaches a curved construction having hanger refractories with planar surfaces which converge toward the cold side and filler refractories with planar surface which converge toward the hot side.

U.S. Pat. No. 4,463,689 teaches a high temperature furnace nose construction providing refractory replacement from the cold side of a furnace. A plurality of wedge-shaped refractories and a plurality of rectangular-shaped refractories are arranged to form straight rows along the length of the nose construction. Both the rectangular-shaped and wedge-shaped refractories have planar sides and require a hanger to suspend two adjacent refractories.

U.S. Pat. No. 3,958,519 teaches high temperature furnace construction for flat roofs and walls using refractories having interlocking corrugations. Merkle Engineers, Inc. has used and sold for several years the rectangular filler and hanger refractories as described in the '519 patent. Merkle Engineers, Inc., P.O. Box 312, Galena, Ill. 61036, has published catalog brochures entitled "MODU-LOK" and "Suspended and Tied Back Refractory Systems for Incineration and Resource Recovery Projects" describing these rectangular filler and hanger refractories.

SUMMARY OF THE INVENTION

It is an object of this invention to provide a nose construction, particularly for high temperature furnaces, in which a combination of rectangular filler refractories and radial filler refractories are supported by rectangular hanger refractories.

It is another object of this invention to provide a nose construction, particularly for high temperature furnaces, which can be easily constructed in the field requiring little, if any, cutting or trimming of refractories to turn a corner.

It is yet another object of this invention to provide a nose construction, particularly for high temperature furnaces, which reduces field construction time by significantly reducing the number of suspension hangers required to suspend the nose construction.

In a preferred embodiment of this invention, a curved nose construction has rectangular hanger refractories suspended from a support structure with a combination of radial wedge-shaped filler refractories and rectangular filler refractories supported by rectangular hanger refractories. Each radial filler refractory has converging tread sides and each rectangular filler refractory and each rectangular hanger refractory have four tread sides. Tread sides of a radial filler refractory mate with the tread sides of a rectangular filler refractory or rectangular hanger refractory. Any combination of at least one radial filler refractory and at least one rectangular filler refractory or rectangular hanger refractory may be adjacent to each other to form the curved nose construction. In various combinations a number of angular constructions may be effected, such as 90°, 60°, and 30°, using the same radial filler refractory design.

Each radial filler refractory has a generally planar top and bottom, a generally planar front and back, a first tread side, and an opposite second tread side. The first tread side and second tread side have corrugations comprising alternating tread ridges and tread grooves. The first tread side and the second tread side each have equal numbers of tread ridges an tread grooves. The first tread side and second tread side converge toward the top, or cold side, and the refractory is symmetric about a plane passing through the midpoints of the top and bottom and perpendicular to both the front and the back of the refractory. In a preferred embodiment of this invention, the radial filler refractory bottom, or hot side, forms a convex arc which extends from the first tread side to the second tread side. It is apparent that the radial filler refractory bottom can have a generally planar bottom in lieu of a bottom forming a convex arc, particularly when the width of the bottom is relatively small. A nose construction having several radial filler refractories with generally planar bottoms will provide an overall curve in the nose construction. The radial filler refractory top, or cold side, has a shorter width than the radial filler refractory bottom due to the converging tread sides.

Each rectangular filler refractory or rectangular hanger refractory has a generally planar rectangular top, a generally planar rectangular bottom, a rectangular tread front, a rectangular tread back, a rectangular first tread side, and a rectangular second tread side. The rectangular tread front and rectangular tread back have corrugations comprising alternating ridges and grooves. The front and back each have an equal number of tread ridges and tread grooves which are asymmetric about a first plane parallel to and central with respect to the ends of the tread ridges of the front and back.

The rectangular first tread side and the rectangular second tread side also have corrugations comprising alternating ridges and grooves. The first tread side and second tread side each have an equal number of ridges and grooves which are symmetric about a second plane parallel to and central with respect to the ends of the tread ridges of the first tread side and second tread side.

In a preferred embodiment of this invention, each radial filler refractory has a tread ridge at its lowest portion adjacent the bottom and a tread groove at the uppermost portion adjacent the top. Each rectangular filler refractory or rectangular hanger refractory that is adjacent a radial filler refractory has a tread groove at its lowest portion of the first tread side and a tread ridge located at the uppermost portion of the first tread side mating with the adjacent radial filler refractory.

The tread ridges and tread grooves have tapered sides and rounded corners.

In a preferred embodiment of this invention, each suspension hanger has a hanger clamp, a hanger rod, and a pickup support with one end of the hanger rod secured to the pickup support and an opposite end secured to the hanger clamp. The top portion of a rectangular hanger refractory has an additional tread groove and an additional tread ridge as compared with a rectangular filler refractory. A hanger clamp is secured to the uppermost tread ridge of the hanger refractory.

DESCRIPTION OF THE PREFERRED EMBODIMENTS

Figure 1A:
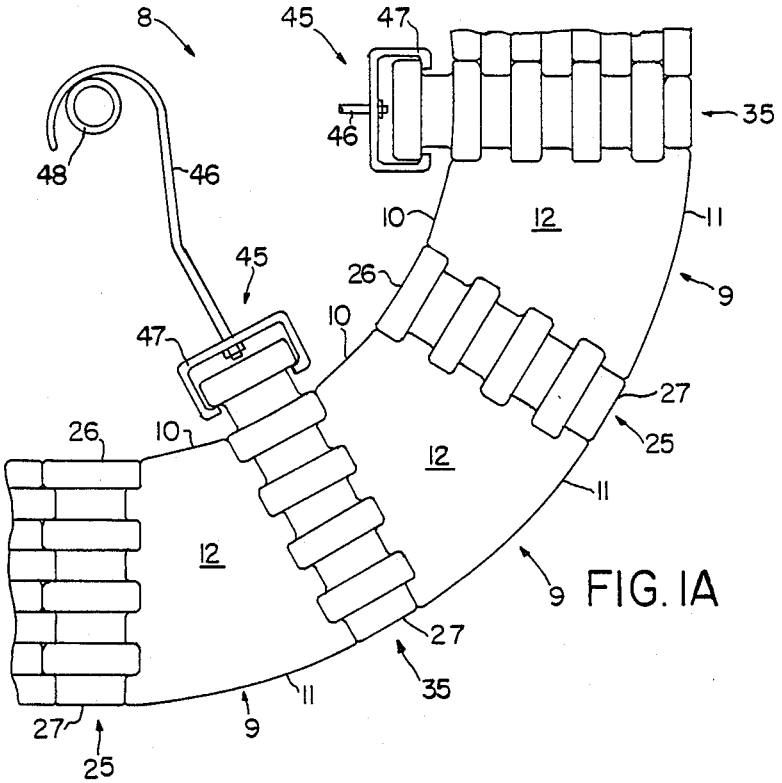
FIG. 1A shows a front view of one layer of a nose construction having three radial filler refractories and two rectangular filler refractories and two rectangular hanger refractories according to one embodiment of this invention.
Figure 1B:
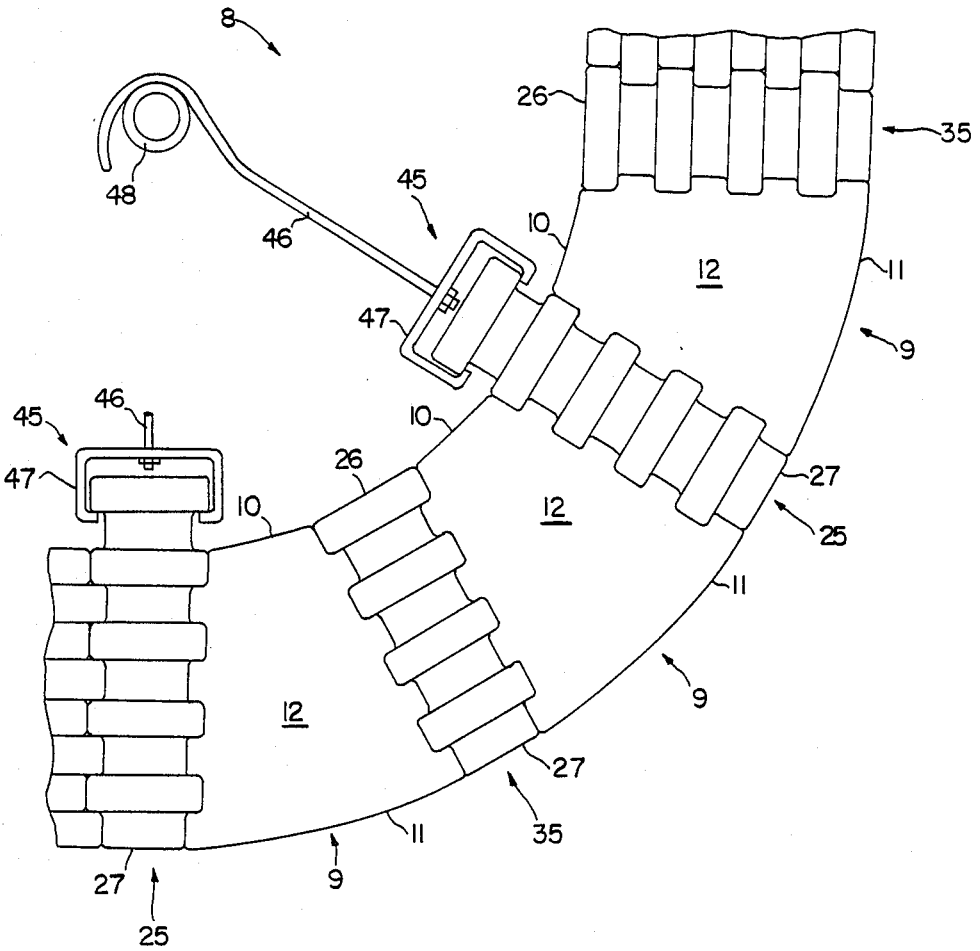
FIG. 1B shows a front view of the next adjacent layer to the layer shown in FIG. 1A.
Figure 6:
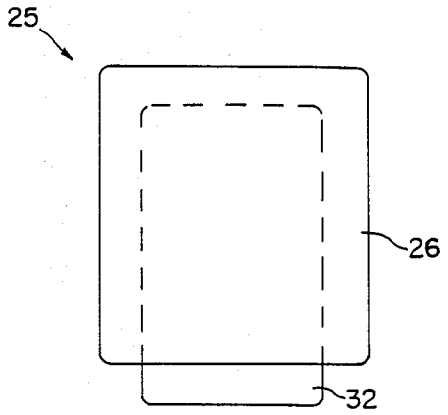
FIG. 6 shows a top view of the rectangular filler refractory as shown in FIG. 4.

FIG. 1A shows nose construction 8, of one layer according to a preferred embodiment of this invention, which forms a 90° bend in the refractory construction. As shown in FIG. 1A, nose construction 8 includes three radial filler refractories 9, two rectangular filler refractories 25 and two rectangular hanger refractories 35 forming the 90°bend. The next adjacent layer is shown in FIG. 1B. The nose construction is made up of alternating layers as shown in FIGS. 1A and 1B across the entire width of the nose. Other nose construction angles can also be provided using the same radial filler refractories: a 60° bend may use a combination of two radial filler refractories with one rectangular hanger refractory and two rectangular filler refractories (FIG. 1A) or two rectangular hanger refractories and one rectangular filler refractory (FIG. 1B); a 30° bend may use one of each the radial filler refractory, rectangular filler refractory and rectangular hanger refractory. Different angles of convergence of the radial filler refractory may, of course, be used to provide a turn of any desired angle in accordance with this invention.

Figure 2:
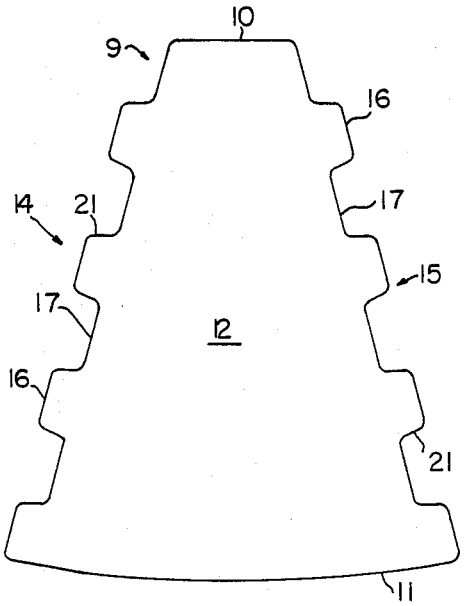
FIG. 2 shows a front view of a radial filler refractory according to one embodiment of this invention.
Figure 3:
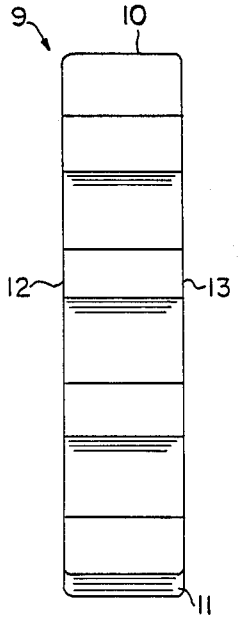
FIG. 3 shows a side view of the radial filler refractory as shown in FIG. 2.

As shown in FIGS. 2 and 3, radial filler refractory 9 has top 10, bottom 11, front 12, back 13, tread side 14 and tread side 15. Tread side 14 and tread side 15 each have alternating tread ridges 16 and tread grooves 17. Radial filler refractory 9 has an equal number of tread ridges 16 and tread grooves 17 on each of radial brick tread sides 14, 15 which are symmetric about a central plane perpendicular to front 12 and back 13 which passes through the midpoints of top 10 and bottom 11. Bottom 11 forms a convex arc which extends between tread sides 14, 15. It is apparent that bottom 11 can be generally planar, particularly when the width of bottom 11 is relatively small. A nose construction having several radial filler refractories 9 with generally planar bottoms will provide an overall curve or bend in the nose construction. Radial filler refractory 9 has an overall wedge shape with opposing tread sides 14 and 15 converging toward top 10.

As shown in FIG. 2, tapered ridge sides 21 of tread ridge 16 form an angle such that tread ridge 16 has an overall outwardly converging shape. Such shape allows easy mating and interlocking with a rectangular filler or hanger refractory. In a mated or interlocked position, tapered ridge sides 21 form a gap. Mortar may be used to fill the gap and additionally secure the positions of the refractories.

Figure 4:
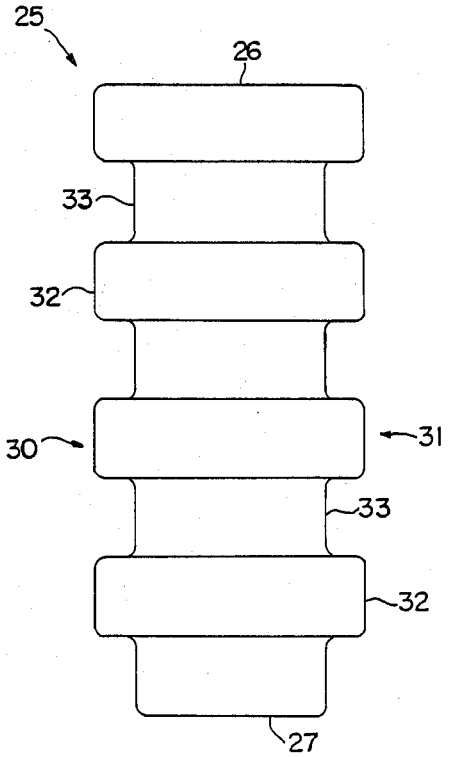
FIG. 4 shows a front view of a rectangular filler refractory according to one embodiment of this invention.
Figure 5:
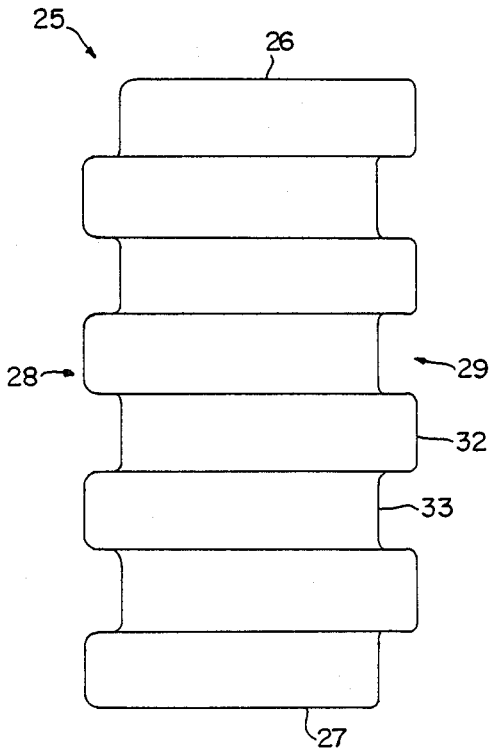
FIG. 5 shows a side view of the rectangular filler refractory as shown in FIG. 4.

As shown in FIG. 4, rectangular filler refractory 25 and rectangular hanger refractory 35 have a generally planar rectangular top 26, generally planar bottom 27, tread front 28, tread back 29, tread side 30 and tread side 31. Tread front 28 and tread back 29 have corrugations comprising alternating tread ridges 32 and tread grooves 33. Tread front 28 and tread back 29 each have an equal number of tread ridges 32 and tread grooves 33 and are asymmetric about a first plane parallel to and equidistant from the ends of tread ridges 32 of tread front 28 and tread back 29. Tread side 30 and tread side 31 have corrugations comprising alternating tread ridges 32 and tread grooves 33, as shown in FIG. 4. Tread side 30 and tread side 31 each have an equal number of tread ridges 32 and tread grooves 33 and are symmetric about a second plane parallel to and equidistant from the ends of tread ridges 32 of tread sides 30, 31. Rectangular filler refractory 25 and rectangular hanger refractory 35 have tread grooves 33 located at the lowest portion of rectangular filler refractory 25 and rectangular hanger refractory 35, and tread ridge 32 at the uppermost portion of rectangular filler refractory 25 and rectangular hanger refractory 35.

In a preferred embodiment of this invention, tread ridges 16, 32, tread grooves 17, 33, have rounded corners. It is readily apparent that the refractories used in this invention may have different numbers of tread ridges and tread grooves than shown in the illustrated embodiments as long as their relationships as described above are maintained. Likewise, the size of the refractories may vary considerably dependent upon the specific application.

Suspension hanger 45 has hanger clamp 47, hanger rod 46 and pickup support 48. It is apparent that pickup support 48 can be a stationary rod, a stationary I-beam, a framework and the like, to which hanger rod 46 can be secured. Hanger rod 46 has one end secured to pickup support 48 and an opposite end secured to hanger clamp 47. Hanger clamp 47 secures to a top portion of rectangular hanger refractory 35. Any suitable suspension hanger means for suspending rectangular hanger refractory 35 may be used in the curved nose refractory construction of this invention. Longer hangers may be used, for example, to provide space for insulation.

As best seen in FIGS. 1A and 1B, rectangular hanger refractory 35 to which hanger clamp 47 attaches has an additional tread groove 33 and an additional tread ridge 32 beyond top 26 as compared with rectangular filler refractory 25. Hanger clamp 47 attaches around the additional tread ridge 32 located at the uppermost portion of rectangular hanger refractory 35.

FIG. 1A shows a front view of one layer of refractories and FIG. 1B shows a front view of an adjacent layer of refractories of a 90° nose construction according to one embodiment of this invention. It is apparent that other combinations of radial filler refractories 9 and/or rectangular filler refractories 25 can be supported by and between two suspended rectangular hanger refractories 35. An important aspect of this invention is support of radial filler refractories by radially adjacent rectangular filler and/or rectangular hanger refractories. An odd number plurality of rectangular filler refractories 25 can be supported between two radial filler refractories 9 by alternately inverting the rectangular filler refractories to mate and interlock with each other or a radial tread side of a radial filler refractory 9. It is apparent that radial filler refractories 9, rectangular filler refractories 25 and rectangular hanger refractories 35 can have various dimensions which may require more or fewer total refractories to form a 90° nose construction bend or a nose construction bend having a different angle. A preferred embodiment of this invention uses at least one suspended rectangular hanger refractory 3 to support at least one radial filler refractory 9 and at least one rectangular filler refractory 25.

Refractories for use in the nose construction of this invention may be manufactured from materials and by processes known to the art which will be apparent upon reading this disclosure. Likewise, suspension hangers 45 or other support means may be manufactured from materials known to the art which will be apparent upon reading this disclosure.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a high temperature furnace, a suspended curved nose construction having its center of radius exterior to said furnace, comprising: at least one radial filler refractory having opposite tread sides converging towards its cold top and an adjacent rectangular hanger refractory having opposite tread sides mateable with said tread sides of said radial filler refractory, and suspension means attached only to said rectangular hanger refractory whereby said hanger refractory supports said adjacent radial filler refractory forming a section of said curved nose construction.

2. A curved nose construction according to claim 1 wherein each said radial filler refractory has a generally planar top, a generally planar bottom, a generally planar front, a generally planar back, a first tread side, and a second tread side, each said first tread side and said second tread side having an equal number of alternating tread ridges and tread grooves, said first tread side and said second tread side being symmetric about a plane passing through midpoints of said top and said bottom and perpendicular to said front and said back, and said top has a width shorter than the width of said bottom.

3. In a high temperature furnace, a suspended curved nose construction having its center of radius exterior to said furnace, comprising: at least one radial filler refractory having opposite tread sides converging toward its cold top and a generally planar top, a generally planar bottom, a generally planar front, a generally planar back, a first tread side, and a second tread side, each said first tread side and said second tread side having an equal number of alternating tread ridges and tread grooves, said first tread side and said second tread side being symmetric about a plane passing through midpoints of said top and bottom and perpendicular to said front and said back, and said top has a width shorter than the width of said bottom; at least one rectangular filler refractory; at least one rectangular hanger refractory; each said rectangular filler refractory and each said rectangular hanger refractory having opposite tread sides mateable with said tread sides of said radial filler refractory, each said rectangular filler refractory and said rectangular hanger refractory have a generally planar top, a generally planar bottom, a tread front, a tread back, said tread front and said tread back each having an equal number of alternating tread ridges and tread grooves, said tread front and said tread back being asymmetric about a first plane parallel to and equidistant from the ends of said tread ridges of said tread front and said tread back, a first tread side, a second tread side, said first tread side each having an equal number of alternating tread ridges and tread grooves, said first tread side and second tread side being symmetric about a second plane parallel to and equidistant from the ends of said tread ridges of said first tread side and said second tread side, any combination of said at least one radial filler refractory and said at least one rectangular filler refractory adjacently mated and supported by said rectangular hanger refractory forming at least a section of curved nose construction; and suspension means for suspending said at least one rectangular hanger refractory.

4. A curved nose construction according to claim 3 wherein each said radial filler refractory has one said tread ridge at the lowest portion of said radial filler refractory and one said tread groove at the uppermost portion of said radial filler refractory.

5. A curved nose construction according to claim 4 wherein each said rectangular filler refractory and said rectangular hanger refractory that is adjacent at least one said radial filler refractory has one said tread groove at the lowest portion of said first tread side and one said tread ridge at the uppermost portion of said first tread side.

6. A curved nose construction according to claim 5 wherein said bottoms of said radial filler refractories have a convex arc surface extending from said first tread side to said second tread side.

7. A curved nose construction according to claim 6 wherein said suspension means are secured to said at least one rectangular hanger refractory and a radial filler refractory is adjacent to and supported by each said rectangular hanger refractory, said radial filler refractories having a rectangular filler refractory therebetween.

8. A curved nose construction according to claim 1 wherein each said radial filler refractory has one said tread ridge at the lowest portion of said radial filler refractory and one said tread groove at the uppermost portion of said radial filler refractory.

9. A curved nose construction according to claim 1 wherein said bottoms of said radial filler refractories have a convex arc surface extending from said first tread side to said second tread side.

10. In a high temperature furnace, a 90° suspended curved nose construction having its center of radius exterior to said furnace, comprising: a plurality of adjacent layers of refractories across the width of said nose, each layer comprising three radial filler refractories having opposite mateable tread sides converging towards its cold top; two rectangular filler refractories; two rectangular hanger refractories; each said rectangular filler refractory and each said rectangular hanger refractory having opposite tread sides of said radial filler refractories, each said radial filler refractory adjacently mated to one said rectangular filler refractory and adjacently mated and supported by one said rectangular hanger refractory, said rectangular filler refractory and said rectangular hanger refractory alternating in said adjacent layers.

* * * * *